US008044911B2

(12) United States Patent
Chung

(10) Patent No.: US 8,044,911 B2
(45) Date of Patent: Oct. 25, 2011

(54) SOURCE DRIVING CIRCUIT AND LIQUID CRYSTAL DISPLAY APPARATUS INCLUDING THE SAME

(75) Inventor: Kyu-Young Chung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1010 days.

(21) Appl. No.: 11/743,363

(22) Filed: May 2, 2007

(65) Prior Publication Data

US 2008/0062027 A1 Mar. 13, 2008

(30) Foreign Application Priority Data

May 2, 2006 (KR) ..... 10-2006-0039460

(51) Int. Cl.
*G09G 3/36* (2006.01)

(52) U.S. Cl. ..... 345/98; 345/96; 345/204; 345/77; 345/99; 365/149

(58) Field of Classification Search ..... 345/87, 345/204, 98, 96, 77; 365/149
See application file for complete search history.

(56) References Cited

U.S. PATENT DOCUMENTS

| | | | | |
|---|---|---|---|---|
| 5,754,150 | A * | 5/1998 | Matsui | 345/89 |
| 6,407,732 | B1 * | 6/2002 | Stiens et al. | 345/204 |
| 6,515,892 | B1 * | 2/2003 | Itoh et al. | 365/149 |
| 6,873,311 | B2 * | 3/2005 | Yoshihara et al. | 345/87 |
| 7,907,108 | B2 * | 3/2011 | Chung | 345/98 |
| 2002/0126107 | A1 * | 9/2002 | Inoue et al. | 345/204 |
| 2002/0190971 | A1 * | 12/2002 | Nakamura et al. | 345/204 |
| 2003/0030614 | A1 * | 2/2003 | Tajima et al. | 345/89 |
| 2004/0041773 | A1 * | 3/2004 | Takeda et al. | 345/98 |
| 2005/0088394 | A1 * | 4/2005 | Chung | 345/96 |

FOREIGN PATENT DOCUMENTS

| | | |
|---|---|---|
| JP | 10-031201 | 2/1998 |
| JP | 2002-366105 | 12/2002 |
| JP | 2004-163912 | 6/2004 |
| JP | 2005-037834 | 2/2005 |

* cited by examiner

*Primary Examiner* — Alexander S Beck
*Assistant Examiner* — Grant Sitta
(74) *Attorney, Agent, or Firm* — F. Chau & Associates, LLC

(57) ABSTRACT

A source driving circuit includes a source driver circuit, an intermediate voltage generator, and a switching control unit. The source driver circuit receives display data and generates a source driving voltage corresponding to the received display data The intermediate voltage generator generates an intermediate source driving voltage. The switching control unit receives a plurality of control signals for selectively applying the source driving voltage and the intermediate source driving voltage to data lines of a display as a driving voltage and controls an order of transition to final levels of a common electrode voltage and the driving voltage. The common electrode voltage may be applied to a common electrode of a liquid crystal capacitor coupled to the data line of the display.

29 Claims, 10 Drawing Sheets

SOURCE DRIVING CIRCUIT AND LIQUID CRYSTAL DISPLAY APPARATUS INCLUDING THE SAME

CROSS-REFERENCE TO RELATED APPLICATION

This application claims priority under 35 USC §119 to Korean Patent Application No. 2006-0039460, filed on May 2, 2006 in the Korean Intellectual Property Office (KIPO), the disclosure of which is incorporated herein in its entirety by reference.

BACKGROUND OF THE INVENTION

1. Technical Field

The present disclosure relates to circuits and methods for driving flat panel displays and, more particularly, to source driving circuits and methods, and a liquid crystal display apparatus capable of reducing power consumption for driving data lines of flat panel displays.

2. Discussion of Related Art

Various types of flat panel displays, such as a liquid crystal display (LCD), a plasma display panel (PDP), an electroluminescence display panel, and the like, have been developed to replace traditional cathode ray tube (CRT) displays. Such flat panel displays are suitable for devices and applications requiring small dimensions, light weight, and low power consumption. For example, LCDs can be operated using large-scale integration (LSI) drivers, because LCDs can be driven by a low-voltage power supply and have a low power consumption. Accordingly, LCDs have been widely implemented for laptop computers, cellular phones, pocket computers, automobiles, and color televisions. For features such as light weight, smaller dimensions, and low power consumption, LCD devices are widely used in portable devices.

FIG. 1 is a diagram illustrating a conventional display system.

Referring to FIG. 1, the display system 100 includes a display panel 110 (for example, LCD) and a plurality of components for driving/controlling the display panel 110 including a source driving IC 120, a gate driving IC 130, a controller 140 having a graphic random access memory (GRAM), and a power generator 150. The controller 140 generates control signals for controlling the power generator 150, the source driving IC 120 and the gate driving IC 130.

The display panel 110 includes a plurality of data lines D1 to Dm that are connected to the source driving IC 120 and a plurality of gate lines G1 to Gn that are connected to the gate driving IC 130. The display panel 110 includes a plurality of pixels/subpixels that are arrayed in a matrix of rows and columns. The pixels/subpixels in a given column are commonly connected to a data line. Assuming the display panel 110 is a TFT-LCD, the display panel 110 may include a thin-film transistor (TFT) board including a plurality of pixel/subpixel units arranged in matrix form. As illustrated in FIG. 1, each pixel/subpixel unit includes a TFT, a liquid crystal capacitor CL, which is connected between a drain electrode of the TFT and a common electrode VCOM, and a thin-film storage capacitor Cst, which is connected in parallel with the liquid crystal capacitor CL. The storage capacitor Cst stores an electric charge so that an image on the display is maintained during a non-selected period. The liquid crystal capacitor CL is formed by a common electrode VCOM of a color filter plate, a pixel electrode of the TFT, and liquid crystal material therebetween. A source electrode of the TFT is connected to a data line and a gate electrode of the TFT is connected to a gate line. The TFT acts as a switch that applies a source voltage on the data line to the pixel electrode when a gate driver signal on the gate line is applied to the gate of the TFT.

The power generator 150 generates a plurality of reference voltages, including, AVDD (source driver power supply), and GVDD (gamma reference voltage), which are applied to the source driving IC 120, VCOMH (high common electrode voltage) and VCOML (low common electrode voltage), which are applied to the common voltage electrode VCOM of the display panel 110, and VGON (gate driver turn-on voltage) and VGOFF (gate driver turn-off voltage), which are applied to the gate driver 1C 130 for driving selected gate lines.

The controller 140 receives as input a plurality of driving data signals and driving control signals (not shown) that are output from an image supply source for example, a main board of a computer (not shown). The driving data signals includes R, G, and B data for forming an image on the display panel 110. The driving control signals include vertical synchronous signals, horizontal synchronous signals, a data enable signal, and a clock signal. The controller 140 outputs to the source driving IC 120 a plurality of display data signals DDATA, which correspond to R, G, and B data, and source control signals. The controller 140 outputs gate control signals for controlling the gate driving IC 130. The controller 140 controls the timing for which data and control signals are output from the source driving IC 120 and gate driving IC 130. For example, in one mode of operation, the controller 140 generates the source and gate control signals such that the gate driving IC 130 transmits a gate driver output signal to each gate line G1 to Gn in a consecutive manner and data voltage is selectively applied to each pixel/subpixel in an activated row, one by one, in order. In another mode of operation, the pixels/subpixels can be charged by sequentially scanning pixels/subpixels in a first column and, thereafter, scanning pixels/subpixels in a next column.

The gate driving IC 130 includes a plurality of gate drivers (not shown) that drive gate lines G1 to Gn, respectively. The source driving IC 120 includes a plurality of source driver circuits 120*a* to 120*m* that drive data lines D1 to Dm, respectively.

FIG. 2 is a schematic diagram illustrating a conventional source driving circuit 200 in the system 100 of FIG. 1.

In general, as illustrated in FIG. 2, the source driving circuit 200 includes a source driver circuit 120*i* that drives a corresponding data line Di, and a grayscale voltage generator 230. The source driving circuit 200 of FIG. 2 illustrates a conventional architecture of the source driver IC 120 of FIG. 1 where there is one source driver circuit 120*i* for each data line (or RGB channel). The grayscale generator 230 may be included in the power generation circuit 150 of FIG. 1. The output of the gray scale generator 230 is commonly coupled to each source driver circuit 120_1 to 120_*m* of the source driving IC 120 in FIG. 1.

In general, the source driver circuit 120*i* includes a polarity inversion circuit 210, a latch circuit 220, a gamma decoder 240, and a driving buffer 250. The source driver 120*i* is controlled by a plurality of control signals that include a polarity control signal M, a latch control signal S_LATCH, and switching control signals. In addition, the source driver 120*i* receives as inputs grayscale reference voltages that are generated by the grayscale voltage generator 230.

The source driver circuit 120*i* receives input display data DDATA of an n-bits for R, G, or B data from the GRAM controller 140. The polarity inversion circuit 210 receives the display data DDATA and controls a polarity of the display data DDATA in response to the polarity control signal M. For example, when the polarity control signal M is logic "0", the polarity of the display data DDATA remains the same as the original display data (positive polarity). On the other hand, when the polarity control signal M is logic "1", the polarity of the display data DDATA is reversed to be inverted display data (negative polarity).

The latch circuit 220 latches the n-bit display data output from the polarity inversion circuit 210 in response to the latch control signal S_LATCH. The latch circuit 220 outputs the latched display data to the gamma decoder 240. The grayscale voltage generator 230 generates and outputs 2" different grayscale voltages to the gamma decoder 240. The gamma decoder 240 decodes the n-bit display data output from the latch circuit 220, and selects and outputs a grayscale voltage to the driving buffer 250.

The driving buffer 250 buffers and amplifies the grayscale voltage output from the gamma decoder 240. The amplified grayscale voltage is selectively applied to the data line of the display panel 110 in response to the switching control signal.

An equivalent capacitance Ceq is present in the source driving signal Sm connected to the common voltage VCOM.

FIG. 3 is a diagram illustrating a conventional common voltage driver circuit 300, which may be included in the power generator 150 of FIG. 1, for driving the common electrode VCOM of the display panel 110.

Referring to FIG. 3, the common voltage driver circuit 300 includes first and second drivers 310 and 320, switches 330 and 340 and capacitors 350 and 360. The first driver 310 buffers and outputs VCOMH (high common voltage) fed thereto. The capacitor 350 is connected to the output of the first driver 310 for stabilizing the output voltage. The switch 330 is controlled by a control signal VCMH_ON for selectively connecting the output of the first driver 310 to the VCOM node N and thereby driving VCOM to VCOMH. The second driver 320 buffers and outputs VCOML (low common voltage) fed thereto. The capacitor 360 is connected to the output of the second driver 320 for stabilizing the output voltage. The switch 340 is controlled by control signal VCML_ON for selectively connecting the output of the second driver 320 to the VCOM node N and thereby driving VCOM to VCOML.

FIG. 4 is a timing diagram illustrating a source driving voltage Sm driven by the source driving circuit 200 of FIG. 2 and a common electrode voltage VCOM driven by the common voltage driver circuit 300 of FIG. 3.

In FIG. 4, a white pattern of a normal black panel is illustrated as an example of the worst case pattern in the display panel 110 of FIG. 1. Referring to FIG. 4, at time T1, the polarity control signal M and the control signal VCMH_ON are enabled and the control signal VCML_ON is disabled. As a result, the switch 330 is closed and the switch 340 is opened, so that common voltage VCOM is driven to VCOMH from VCOML by the first driver 310. At this time, the source output voltage Sm is changed to VL from VH contrary to VCOM. In this exemplary embodiment, VH is the highest gray scale voltage and VL is the lowest gray scale voltage, and T is a toggling period of VCOM.

When display systems such as LCD panels are implemented in small hand-held, portable devices, it is important to reduce the power consumption needed to drive such displays, so as to preserve battery power. In general, the primary sources of power consumption when driving flat panel devices include source drivers and VCOM drivers. More particularly, with source drivers, the voltages for driving the data lines are typically designed with relatively high levels in order to enhance the driving speed of the display, for example, quickly charge and discharge the liquid crystal capacitor CL. Power consumption of the display, however, is increased in proportion to the voltage increase of the driving voltage. Further, driving the common electrode, which faces the pixel electrodes is a significant source of power consumption because the polarity of the common voltage is reversed every cycle.

Generally, the source driving voltage and the VCOM driving voltage are internal voltages that are generated by voltage generators in which such driving voltages are generated by boosting voltage/power output from an intermediate reference voltage source. Thus, the conventional source and VCOM driver circuits increase power consumption, because they use boosted voltages for driving the data lines and providing VCOM.

The average load current consumption for VCOMH driven from the supply voltage AVDD is formulated by the following Equation 1.

$$I_{VCOMH}=(m(VCOMH-VCOML+VH-VL)Ceq)/2T, \quad \text{[Equation 1]}$$

where m denotes a number of source channels, Ceq denotes an equivalent capacitance, and T denotes a toggling period of VCOM.

In addition, the average load current consumption for VCOML driven from VL is formulated by the following Equation 2.

$$I_{VCOML}=(m(VCOMH-VCOML+VH-VL)Ceq)/2T \quad \text{[Equation 2]}$$

Further, the average load current consumption for source driven from voltage AVDD is formulated by the following Equation 3.

$$I_{SRC}=(m(VCOMH-VCOML+VH-VL)Ceq)/2T \quad \text{[Equation 3]}$$

When AVDD corresponds to an output voltage boosted by an amount a provided from an external input power supply voltage, and VCL corresponds to an output voltage boosted by an amount −b provided from the external input power supply voltage, the total average current consumption is formulated by the following Equation 4.

$$I_{TOT}=(2a+b)*(m(VCOMH-VCOML+VH-VL)Ceq)/2T \quad \text{[Equation 4]}$$

SUMMARY OF THE INVENTION

Accordingly, exemplary embodiments of the present invention are provided to substantially obviate one or more problems due to limitations and disadvantages of the related art.

Some exemplary embodiments of the present invention provide a source driving circuit capable of reducing current consumption.

Exemplary embodiments of the present invention provide a liquid crystal display apparatus capable of reducing current consumption.

Some exemplary embodiments of the present invention provide a method of driving data lines of a display capable of reducing current consumption.

In accordance with exemplary embodiments of the present invention, a source driving circuit includes a source driver circuit that receives display data and generates a source driving voltage corresponding to the received display data, an intermediate voltage generator that generates an intermediate source driving voltage, and a switching control unit that receives a plurality of control signals for selectively applying the source driving voltage and the intermediate source driving voltage to data lines of a display as a driving voltage and controls the order of transition to final levels of a common electrode voltage and the driving voltage. The common electrode voltage may be applied to a common electrode of a liquid crystal capacitor coupled to the data line of the display.

In some exemplary embodiments, the switching control unit may include a panel type selector that outputs a panel select signal based on a data pattern bit of the display data and a panel type signal of the plurality of control signals, a first switching signal controller that controls timing for applying the intermediate source driving voltage to the data lines based on the panel select signal and first and second control signals of the plurality of control signals, a second switching signal controller that controls timing for applying the source driving voltage to the data lines based on the panel select signal and third and fourth control signals of the plurality of control signals, a first switch that selectively connects the intermediate source driving voltage to the data lines in response to an output signal of the first switching signal controller, and a second switch that selectively connects the source driving voltage to the data lines in response to an output signal of the first switching signal controller.

In exemplary embodiments, the panel type selector may include an exclusive OR gate.

In some exemplary embodiments, the first and second control signals may control the transition timing of the intermediate source driving voltage to the final level.

In accordance with exemplary embodiments, the first switching signal controller may include a 2-to-1 multiplexer. The driving voltage may transit to the final level prior to the common electrode voltage when the first switching signal controller selects the first control signal. The driving voltage and the common electrode voltage may transit to respective final levels simultaneously when the second switching signal controller selects the second control signal.

In some exemplary embodiments, the third and fourth control signals may control the transition timing of the source driving voltage to the final level.

In accordance with exemplary embodiments, the second switching signal controller may include a 2-to-1 multiplexer. The driving voltage may transit to the final level prior to the common voltage when the second switching signal controller selects the third control signal. The common electrode voltage and the driving voltage may transit to respective final levels simultaneously when the second switching signal controller selects the fourth control signal.

According to exemplary embodiments, the intermediate source driving voltage may correspond to a reference grayscale voltage. More specifically, the intermediate source driving voltage may correspond to a central reference grayscale voltage.

In some exemplary embodiments of the present invention, a liquid crystal display (LCD) apparatus includes a liquid crystal display panel that includes a plurality of gate lines and a plurality of data lines, a gate driver that drives the plurality of gate lines, and a source driver that drives the plurality of data lines. The source driver includes a source driver circuit that receives display data and that generates a source driving voltage corresponding to the received display data, and a switching control unit that receives a plurality of control signals for selectively applying the source driving voltage and the intermediate source driving voltage to the plurality of data lines as a driving voltage and that controls the order of transition to the final level of a common electrode voltage, which is the driving voltage. The common electrode voltage is applied to a common electrode terminal of a liquid crystal capacitor coupled to each of the plurality of data lines.

In some exemplary embodiments, the LCD apparatus may further include a common voltage driver circuit that drives the common electrode voltage.

According to exemplary embodiments, the common voltage driver circuit may include a first driver circuit that outputs a first common voltage, a second driver circuit that outputs a second common voltage, a first intermediate switch that selectively connects the first common voltage to a common electrode of the display panel in response to a first intermediate control signal, a second intermediate switch that selectively connects the second common voltage to the common electrode in response to a second intermediate control signal, and an intermediate voltage output circuit that outputs one or more intermediate common voltages to the common electrode in response to one or more intermediate control signals.

In exemplary embodiments, the first common voltage may correspond to a high common voltage and the second common voltage may correspond to a low common voltage.

According to exemplary embodiments, the common voltage driver circuit may drive the common electrode from the low common voltage to the high common voltage by driving the common electrode with the one or more intermediate common voltages before outputting the high common voltage.

In some exemplary embodiments, the common voltage driver circuit may drive the common electrode from the high common voltage to the low common voltage by driving the common electrode with the one or more intermediate common voltages before outputting the low common voltage.

Exemplary embodiments of the present invention provide a method of driving data lines of a display generating a source driving voltage corresponding to received display data, generating an intermediate source driving voltage, receiving a plurality of control signals for selectively applying the source driving voltage and the intermediate source driving voltage as a driving voltage to the data line of the display, and controlling the order of transition to the final levels of a common electrode voltage, the source driving voltage and the intermediate source driving voltage, the common electrode voltage being applied to a common electrode terminal of a liquid crystal capacitor coupled to the data line of the display.

In some exemplary embodiments, controlling the order of the transition may include outputting a panel select signal based on a data pattern bit of the display data and a panel type signal of the plurality of control signals, applying the intermediate source driving voltage to the data lines by a first switching based on the panel select signal and first and second control signals of the plurality of control signals, and applying the source driving voltage to the data lines by a second switching signal based on the panel select signal and third and fourth control signals of the plurality of control signals.

Therefore by following exemplary embodiments of the present invention, current consumption may be reduced greatly by controlling the timing of transition to final levels of the source output and VCOM.

BRIEF DESCRIPTION OF THE DRAWINGS

Exemplary embodiments of the present invention will be understood in more detail from the following descriptions taken in conjunction with the accompanying drawings.

DESCRIPTION OF EXEMPLARY EMBODIMENTS

Figure 1:
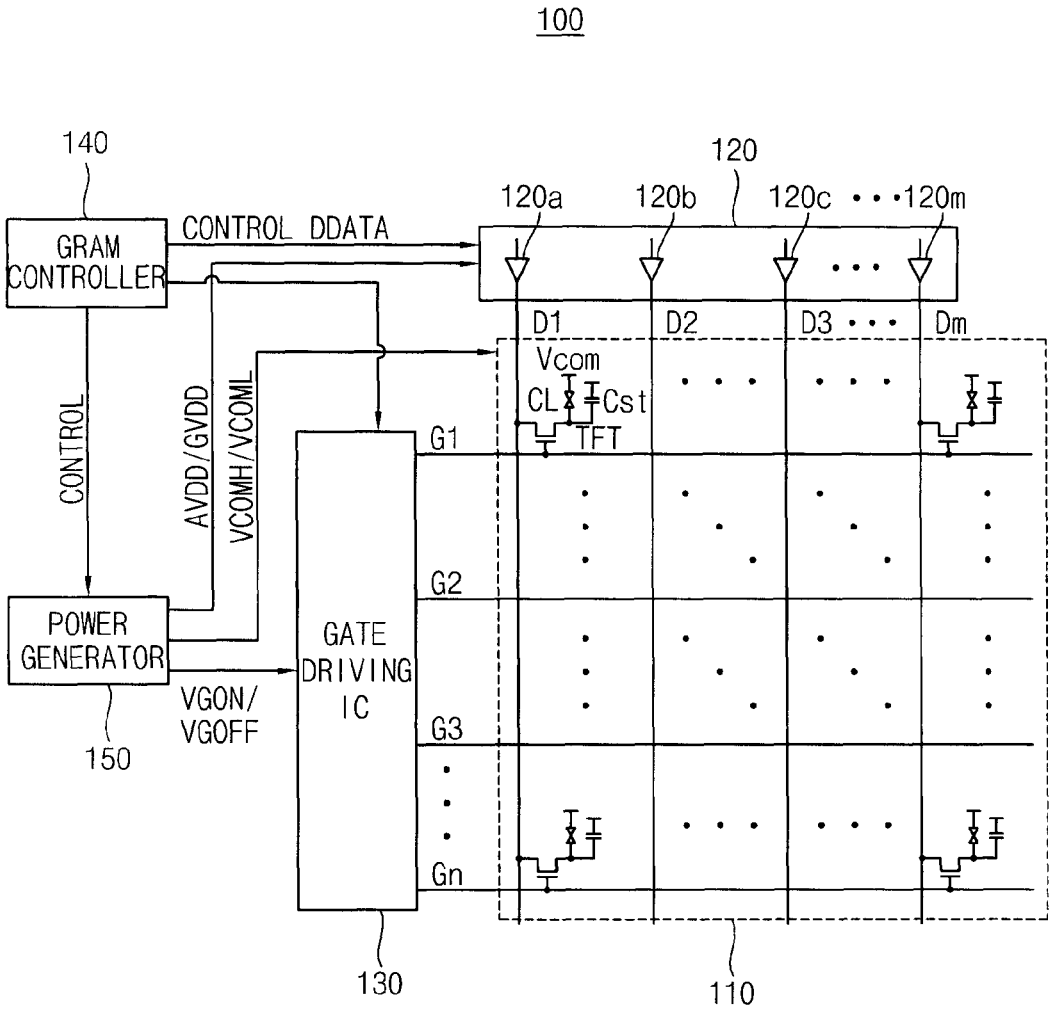
FIG.1 (CONVENTIONAL ART)
FIG. 1 is a diagram illustrating a conventional display system.

Exemplary embodiments of the present invention now will be described more fully with reference to the accompanying drawings, in which exemplary embodiments of the invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the invention to those skilled in the art. Like reference numerals refer to like elements throughout this application.

Figure 5:
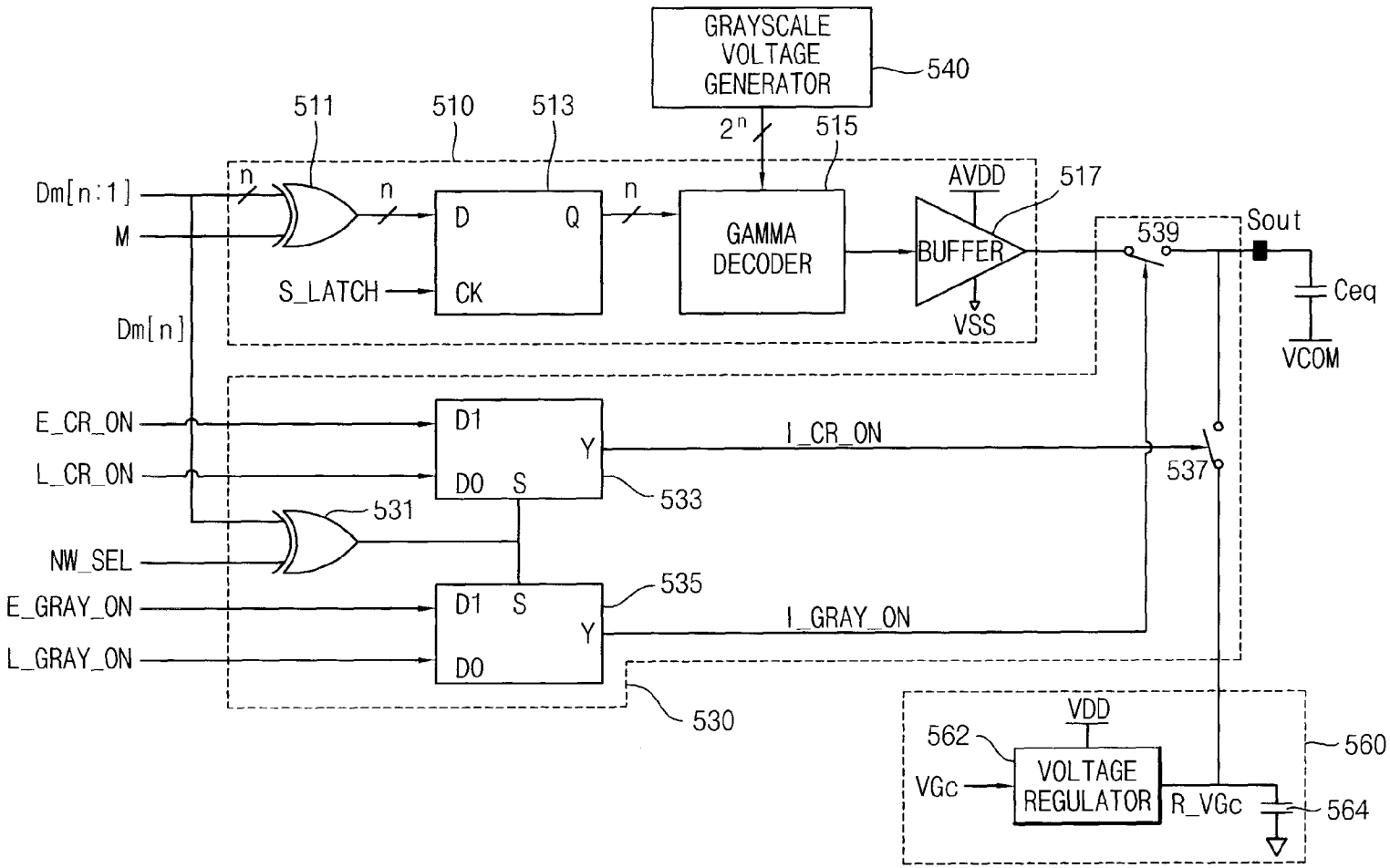
FIG. 5 is a diagram illustrating a source driving circuit according to an exemplary embodiment of the present invention.

FIG. 5 is a diagram illustrating a source driving circuit according to an exemplary embodiment of the present invention. The source driving circuit may be employed in the system of FIG. 1.

Referring to FIG. 5, a source driving circuit 500 includes a source driver circuit 510 that generates a source driving voltage for driving a corresponding data line Dm, a switching control unit 530, a grayscale voltage generator 540, and an intermediate voltage generator 560. The source driving circuit 500 may be implemented in the source driver IC 120 of FIG. 1. The source driver circuit 510 may be assigned for each data line Dm, and the grayscale voltage generator 540 and the intermediate voltage generator 560 are commonly utilized by all source drivers.

The source driver circuit 510 and the grayscale voltage generator 540 operate in a similar manner as the source driver circuit 120*i* and the grayscale voltage generator 230 of FIG. 2 described hereinabove.

The intermediate voltage generator 560 includes a voltage regulator 562, and may further include a capacitor 564. The voltage regulator 562 provides a regulated output voltage R_VGc irrespective of a change of an input voltage VGc. The input voltage VGC may correspond to one of the reference grayscale voltages, or may it correspond to a central reference grayscale voltage. The voltage level of the regulated output voltage R_VGc may be the same as the voltage level of the input voltage VGc. The capacitor 564 may be selectively connected to an output terminal of the voltage regulator 562 for stabilizing the regulated output voltage R_VGc.

The switching control unit 530 includes a panel type selector 531, a first switching signal controller 533, a second switching signal controller 535, a first switch 537, and a second switch 539.

The panel type selector 531 outputs a panel select signal based on a most significant bit (MSB) of the display data Dm and a panel type signal NW_SEL. The MSB of the display data Dm directs that the display data Dm is close to a worst case pattern or a best case pattern. According to exemplary embodiments of the present invention, the display data Dm may correspond to the worst case pattern when the MSB corresponds to "0", whereas the display data Dm may correspond to the best case pattern when the MSB corresponds to "1". According to exemplary embodiments of the present invention, the panel type signal NW_SEL may correspond to logic "1" when the panel type corresponds to a normal black panel, whereas the panel type signal NW_SEL may correspond to logic "0" when the panel type corresponds to a normal white panel. The opposite situation may be possible according to other exemplary embodiments. The panel type selector 531 may be implemented with an exclusive OR gate. In summary, the panel type selector 531 outputs logic "1" when the MSB of the display data and the panel type signal NW_SEL are different from each other.

The first switching signal controller 533 receives a first control signal E_CR_ON and a second control signal L_CR_ON, and selectively outputs one of the first control signal E_CR_ON and the second control signal L_CR_ON in response to an output signal (panel select signal) of the panel type selector 531. The first switching signal controller 533 may be implemented with a 2-to-1 multiplexer. The first control signal E_CR_ON corresponds to a switching control signal between the regulated output voltage R_VGc of the intermediate voltage generator 560 and the source output Sout so that the source output Sout may transit to the final level prior to VCOM. The second control signal L_CR_ON corresponds to a switching control signal between the regulated output voltage R_VGc of the intermediate voltage generator 560 and the source output Sout so that the source output Sout and VCOM may transit to respective final levels simultaneously. That is, when the first control signal E_CR_ON is selected as an output signal I_CR_ON of the first switching signal controller 533, the source output Sout transits to final level prior to VCOM whereas the source output Sout and VCOM transit to respective final levels when the second control signal L_CR_ON is selected as the output signal I_CR_ON of the first switching signal controller 533.

The second switching signal controller 535 receives a third control signal E_GRAY_ON and a fourth control signal L_GRAY_ON, and selectively outputs one of the third control signal E_GRAY_ON and the fourth control signal L_GRAY_ON in response to the panel select signal. The second switching signal controller 535 may be implemented with a 2-to-1 multiplexer. The third control signal E_GRAY_ON corresponds to a switching control signal between the output of the buffer 517 and the source output Sout so that the source output Sout may transit to the final level prior to VCOM. The fourth control signal L_GRAY_ON corresponds to a switching control signal between the output of the buffer 517 and the source output Sout, so that the source output Sout and VCOM may transit to respective final levels simultaneously. That is, when the third control signal E_GRAY_ON is selected as an output signal I_GRAY_ON of the second switching signal controller 535, the source output voltage Sout transits to the final level prior to VCOM, whereas the source output voltage Sout and VCOM transit to respective final levels when the second control signal L_GRAY_ON is selected as the output signal I_CR_ON of the second switching signal controller 535.

The first switch 537 selectively connects the regulated output voltage R_VGc as the source output voltage Sout. The second switch 539 selectively connects the output of the buffer 517 as the source output Sout.

The arrangement of the liquid crystal material in the liquid crystal capacitor Ceq varies according to a voltage difference between the source output Sout and the VCOM voltage, thereby operating the display panel.

Figure 6:
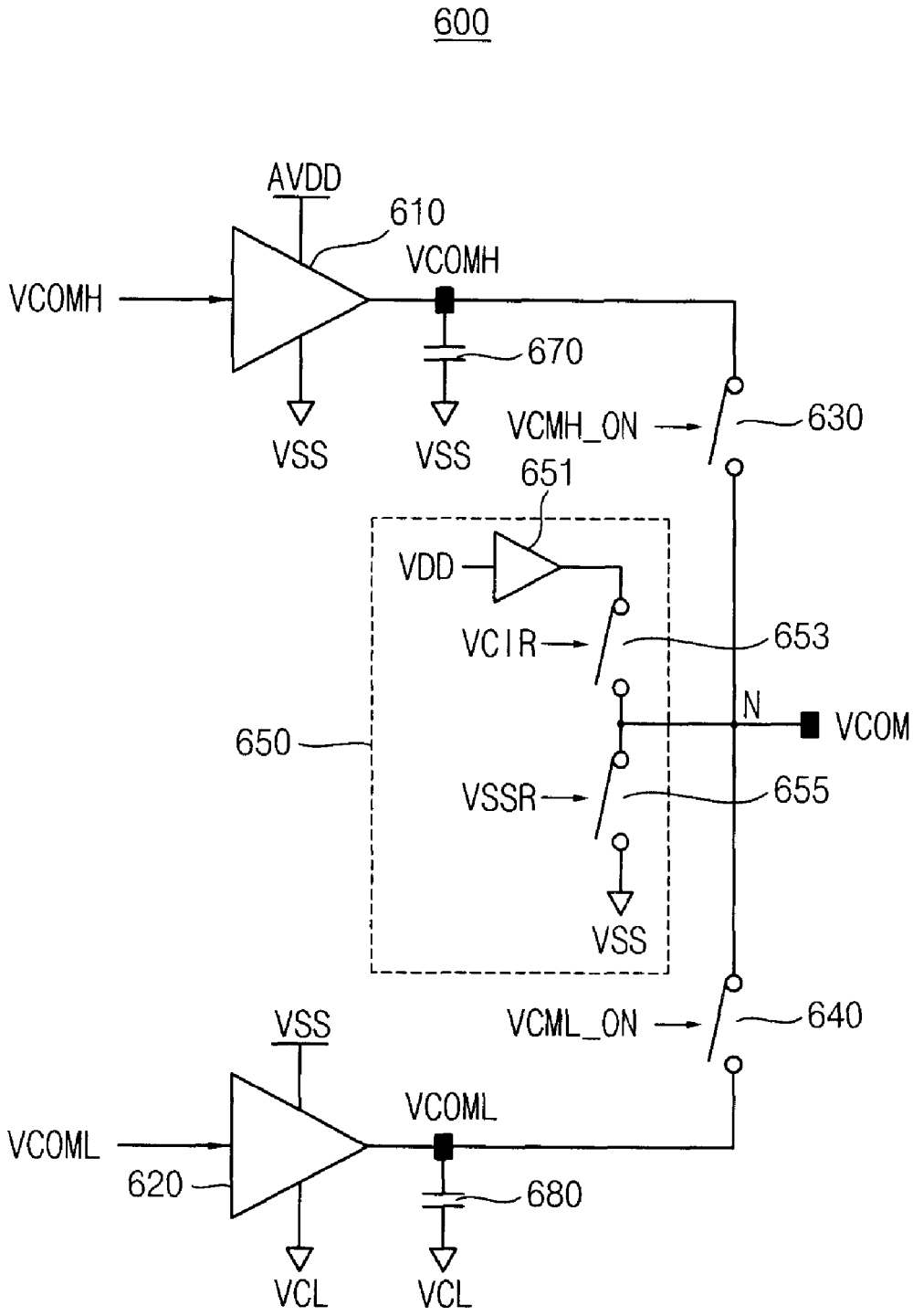
FIG. 6 is a circuit diagram illustrating a common voltage driver circuit that drives the common electrode voltage according to an exemplary embodiment of the present invention.

FIG. 6 is a circuit diagram illustrating a common voltage driver circuit that drives the common electrode VCOM voltage according to an exemplary embodiment of the present invention. The common voltage driver circuit 600 may be employed in the system of FIG. 1.

Referring to FIG. 6, the common voltage driver circuit 600 includes first and second drivers 610 and 620, switches 630 and 640, capacitors 670 and 680, and an intermediate voltage output circuit 650.

The intermediate voltage output circuit 650 includes a third driver 651 that buffers and outputs a reference voltage VDD fed thereto, and switches 653 and 655 that are controlled by intermediate voltage control signals VCIR and VSSR respectively. The switch 653 is controlled to connect the output of the third driver 651 to the VCOM node N, and the switch 655 is controlled to connect the VCOM node N to a ground voltage VSS.

Figure 7:
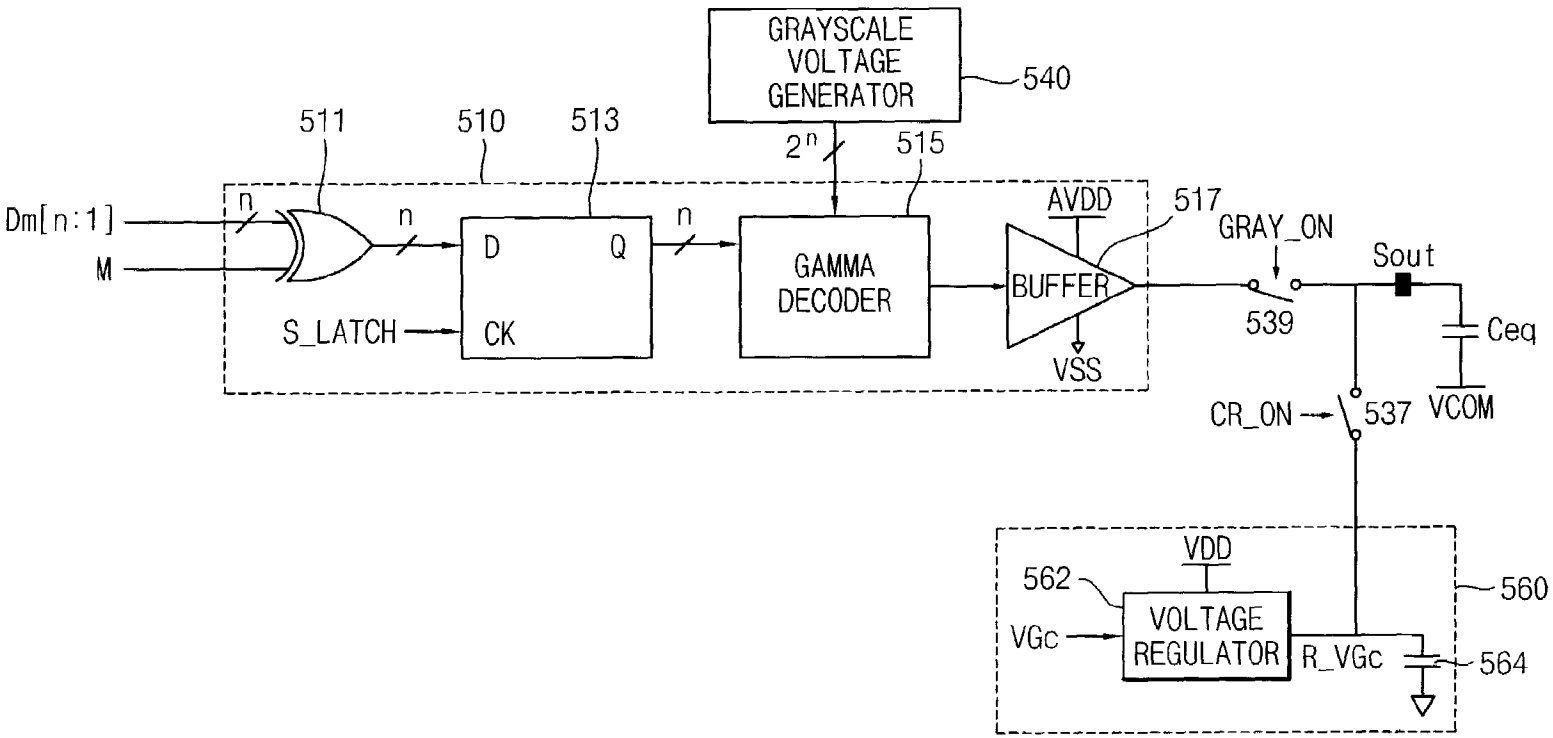
FIG. 7 is a schematic diagram illustrating a source driving circuit without the switching control unit in the source driving circuit of FIG. 5 for explaining the effect of reduction of the current consumption according to an exemplary embodiment of the present invention.
Figure 8:
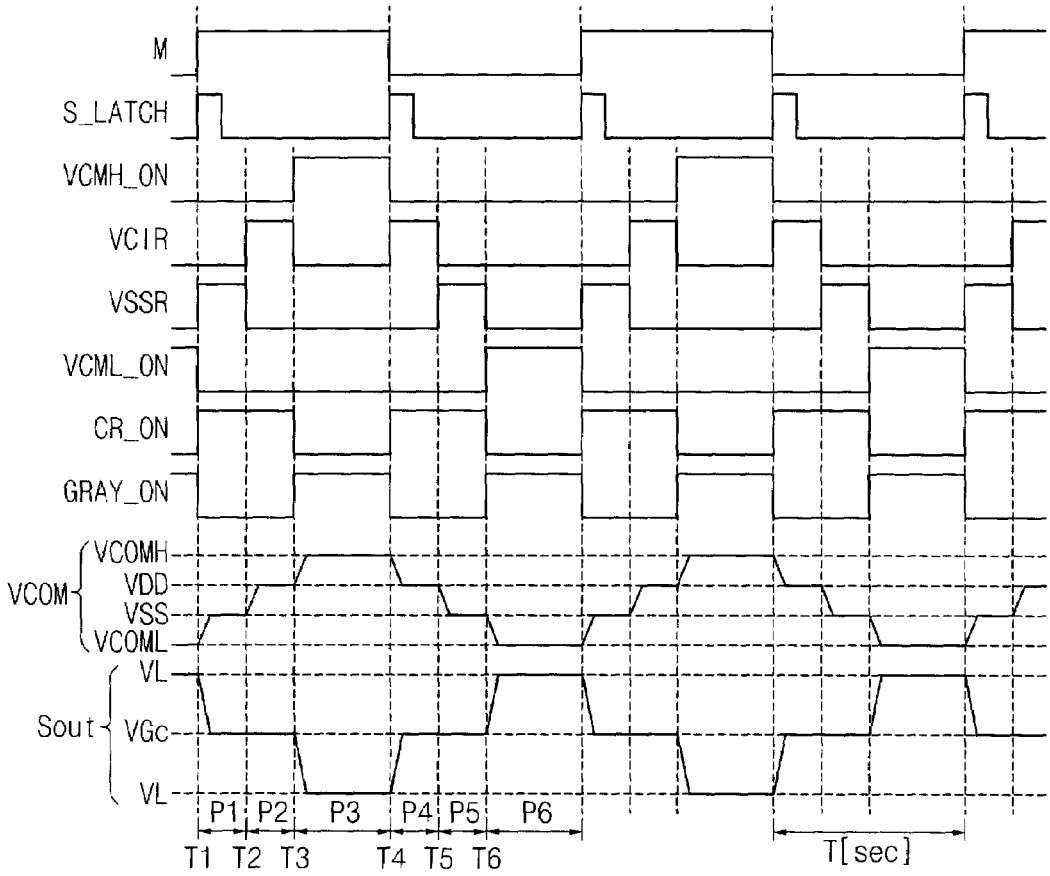
FIG. 8 is a timing diagram illustrating output signals of the source driving circuit of FIG. 7 and the common voltage driver circuit of FIG. 6 according to the control signals.

FIG. 7 is a diagram illustrating a source driving circuit without the switching control unit used in the source driving circuit of FIG. 5 for explaining the effect of a reduction of the current consumption, according to an exemplary embodiment of the present invention. FIG. 8 is a timing diagram illustrating output signals of the source driving circuit of FIG. 7 and the common voltage driver circuit of FIG. 6 according to control signals. FIG. 8 will be explained with reference to FIGS. 6 and 7. The worst case pattern of the display data is assumed in FIG. 8. The output of the common voltage driver circuit of FIG. 6 will be explained first and the source output Sout of the source driving circuit of FIG. 7 will be explained later. The control signal GRAY_ON is a switching control signal that controls switch 539 between the output of the buffer 517 and the source output Sout. In addition, control signal CR_ON is a switching control signal that controls switch 537 between the output of the intermediate voltage generator 560 and the source output Sout.

At this time, control signal CR_ON is disabled, and control signal GRAY_ON is enabled. In addition, the source output Sout is driven to VH, because the worst case pattern is assumed.

Referring to FIG. 8, in the time period before time T1, with polarity control signal M at logic "0", the control signal VCML_ON is enabled (the switch 640 is closed), and control signals VCMH_ON, VCIR and VSSR are disabled. Accordingly, the common electrode VCOM is driven to VCOML by the second driver 620. The control signal CR_ON is in the disabled state, and the control signal is in the enabled state. In addition, the source output Sout is driven to VH, because the worst case pattern of the display data is assumed.

At time T1, the polarity signal M switches to logic "1" to invert the display data, the control signal VCML_ON is disabled to cause the switch 640 to be opened, and control signal VSSR is enabled to cause to the switch 655 to be closed, thereby connecting the VCOM node N to an intermediate voltage VSS (for example, ground). During time period P1, VCOM is driven to VSS from VCOML. At time T1, control signal CR_ON is enabled, and control signal GRAY_ON is disabled. Accordingly, the switch 537 is closed, and the switch 539 is opened. Dining time period P1, the source output Sout is driven to VGc.

At time T2, the control signal VSSR is disabled to cause the switch 655 to be opened, the control signal VCIR is enabled to cause the switch 653 to be closed, thereby connecting the VCOM node N to the output of the third driver 651. Accordingly, during time period P2, VCOM is driven to an intermediate voltage (VDD) from VSS by using VDD power supply. During time period P2, the source output Sout is maintained at VGc, because control signals CR_ON and GRAY_ON are in the same state as in time period P1.

At time T3, the control signal VCIR is disabled to cause the switch 653 to be opened, and the control signal VCMH_ON is enabled to cause the switch 630 to be closed, thereby connecting the output of the first driver 610 to the VCOM node N. Therefore, during time period P3, VCOM is driven to VCOMH from the intermediate voltage (VDD) by the first driver 610. At time T3, the control signal CR_ON is disabled to cause the switch 537 to be opened, and the control signal GRAY_ON is enabled to cause the switch 539 to be closed, thereby driving the source output Sout to VL from VGc.

At time T4, the polarity control signal M switches to logic "0" that indicates display data having a "positive" polarity, the control signal VCMH_ON is disabled to cause the switch 640 to be opened, and the control signal VCIR is enabled to cause the switch 653 to be closed, thereby connecting the VCOM node N to the output of the third driver 651. During time interval P4, VCOM is driven to VDD from VCOMH by the third driver 651. At time T4, the control signal CR_ON is enabled to cause the switch 537 to be closed, and the control signal GRAY_ON is disabled to cause the switch 539 to be opened, thereby driving the source output Sout to VGc from VL during time period P4.

At time T5, the control signal VCIR is disabled to cause the switch 653 to be opened, and the control signal VCMH_ON is enabled to cause the switch 630 to be closed, thereby connecting the VCOM node N to VSS. During time period P5, VCOM is driven to VSS from VDD. The source output Sout is maintained at VGc, because control signals CR_ON and GRAY_ON are in the same state as they were during the time period P4.

At time T6, the control signal VSSR is disabled to cause the switch 655 to open, and the control signal VCML_ON is enabled to cause the switch 640 to be closed, thereby connecting the VCOM node N to the output of the second driver 620. During time interval P5, VCOM is driven to VCOML from VSS. At time T6, the control signal CR_ON is disabled to cause the switch 537 to be opened, and the control signal GRAY_ON is enabled to cause the switch 539 to be closed, thereby driving the source output Sout to VH from VGc during time period P6.

In FIG. 8, the average load current consumption for VCOMH driven from AVDD is formulated by the following Equation 5.

$$I_{VCOMH}=(m(VCOMH-VDD+VGc)Ceq)/2T=(m(VCOMH-VDD+(VH-VL)/2)Ceq)/2T, \quad \text{[Equation 5]}$$

where m denotes a number of source channels, Ceq denotes a capacitance of an equivalent capacitor, and T denotes a toggling period of VCOM.

In addition, the average load current consumption for VCOML driven from VCL is formulated by the following Equation 6.

$$I_{VCOML}=(m(VGc-VCOML)Ceq)/2T=(m((VH-VL)/2-VCOML)Ceq)/2T \quad \text{[Equation 6]}$$

Further, the average load current consumption for a source driven from AVDD is formulated by the following Equation 7.

$$I_{SRC}=(m(VGc-VCOML)Ceq)/2T=(m((VH-VL)/2-VCOML)Ceq)/2T \quad \text{[Equation 7]}$$

Further, the average load current consumption for VDD is formulated by the following Equation 8.

$$I_{VDD}=(m(VGc-(VH-VL-VGc-VCOML)Ceq)2T=m*VCOML*Ceq/2T \quad \text{[Equation 8]}$$

When AVDD corresponds to an output voltage boosted by 'a' from an external input power supply voltage, and VCL corresponds to an output voltage boosted by '−b' from the external input power supply voltage, the total average current consumption is formulated by following Equation 9.

$$I_{TOT} = m(a(VCOMH - VDD + VH - VL - VCOML) + b(VH - VL)/2 - VCOML) + VCOML)Ceq)/2T \quad \text{[Equation 9]}$$

When Equation 9 is subtracted from Equation 4, a difference of the current consumptions may be obtained as the following Equation 10.

$$m((a+b)*VCOMH-(a+1)VCOML+(a+b/2)(VH-VL)+a*VDD)Ceq)/2T \quad \text{[Equation 10]}$$

Figure 2:
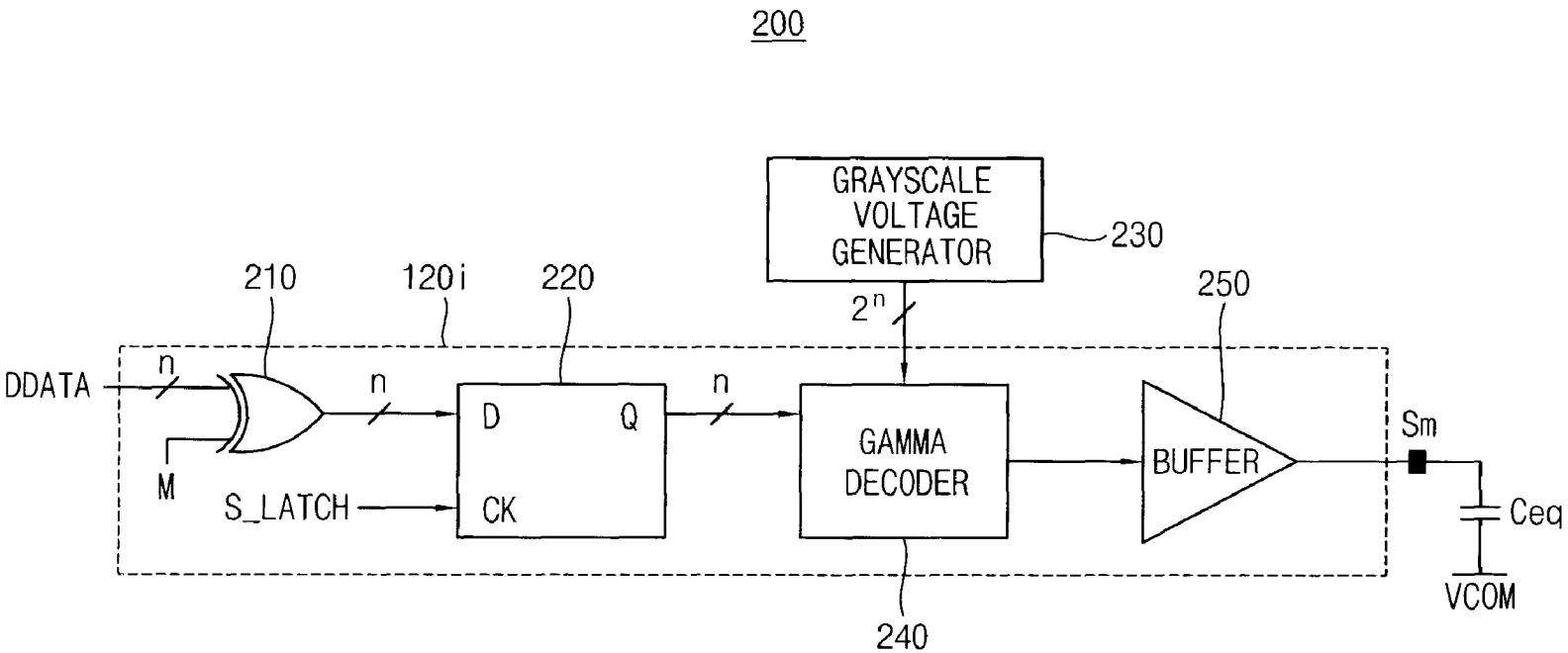
FIG. 2 (CONVENTIONAL ART)
FIG. 2 is a schematic diagram illustrating a conventional source driving circuit used in the system of FIG. 1.
Figure 3:
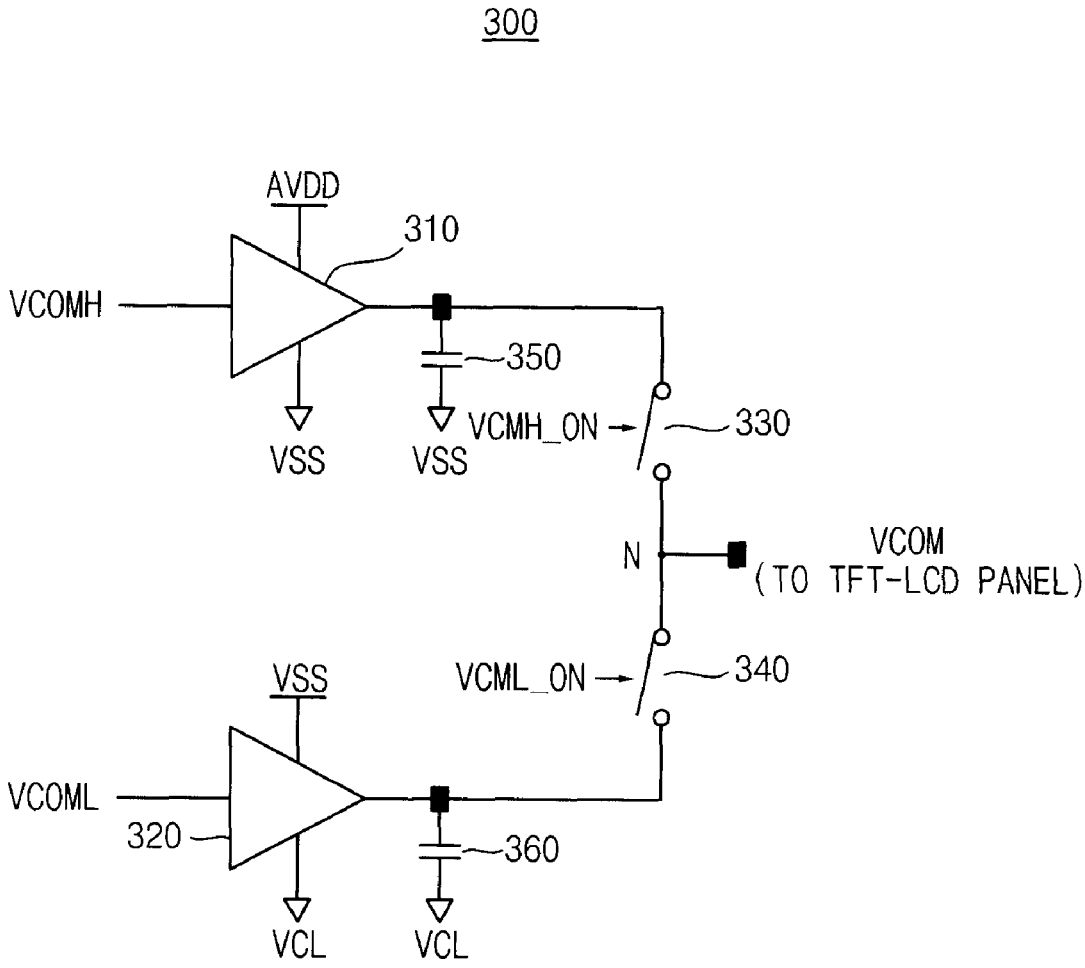
FIG.3 (CONVENTIONAL ART)
FIG. 3 is a diagram illustrating a conventional common voltage driver circuit.
Figure 4:
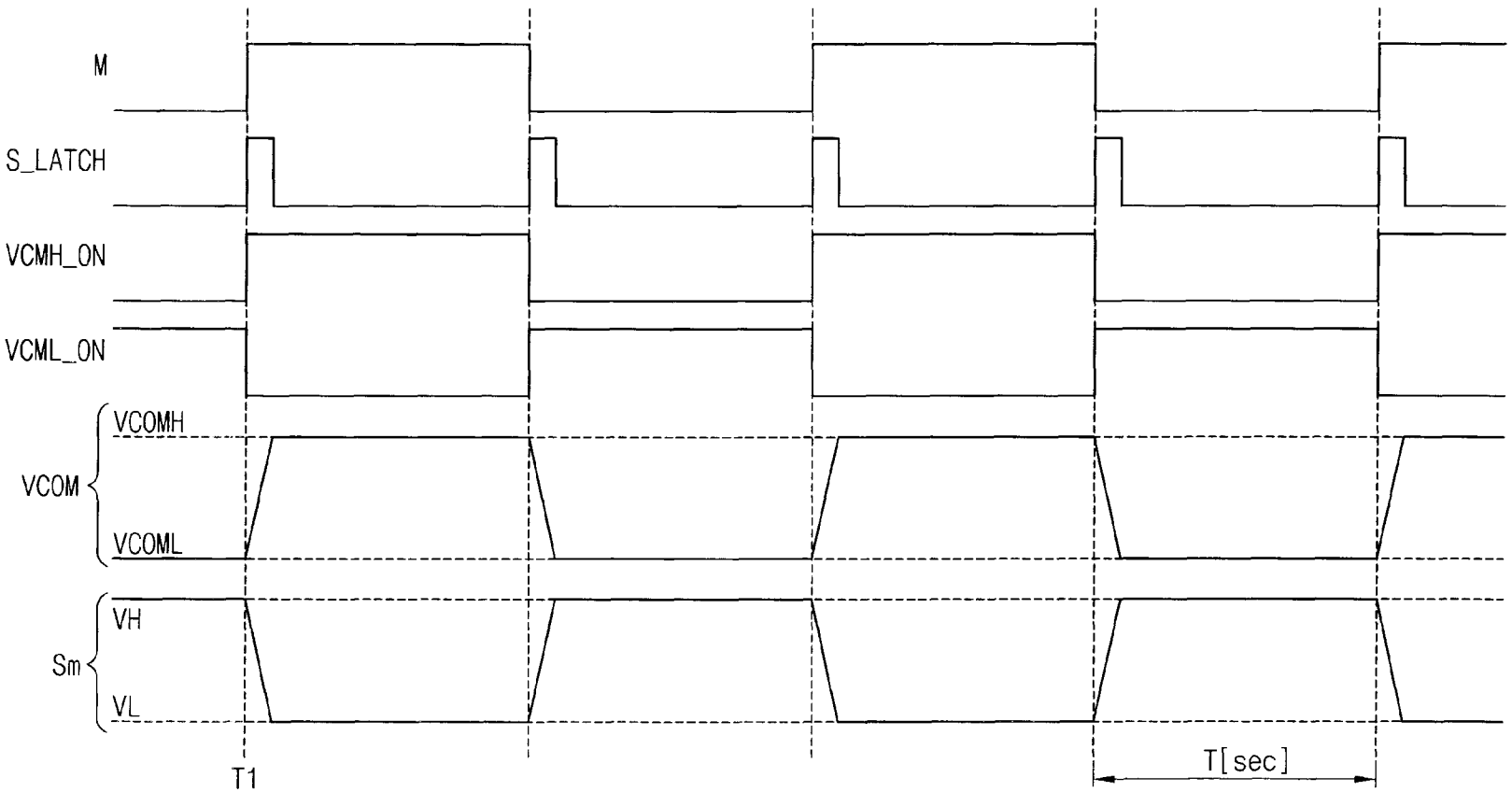
FIG.4 (CONVENTIONAL ART)
FIG. 4 is a timing diagram illustrating a source driving voltage driven by the source driving circuit of FIG. 2 and a common electrode voltage driven by the common voltage driver circuit of FIG. 3.

The current consumption is reduced by the amount of equation 10 when the common voltage generator of FIG. 6 and the source driving circuit of FIG. 7 are employed, compared to when the sourcing driving circuit of FIG. 2 and the common voltage generator of FIG. 3 are employed. In addition, VCOML is a negative value, thus, the reduction of current consumption is relatively large.

Figure 9:
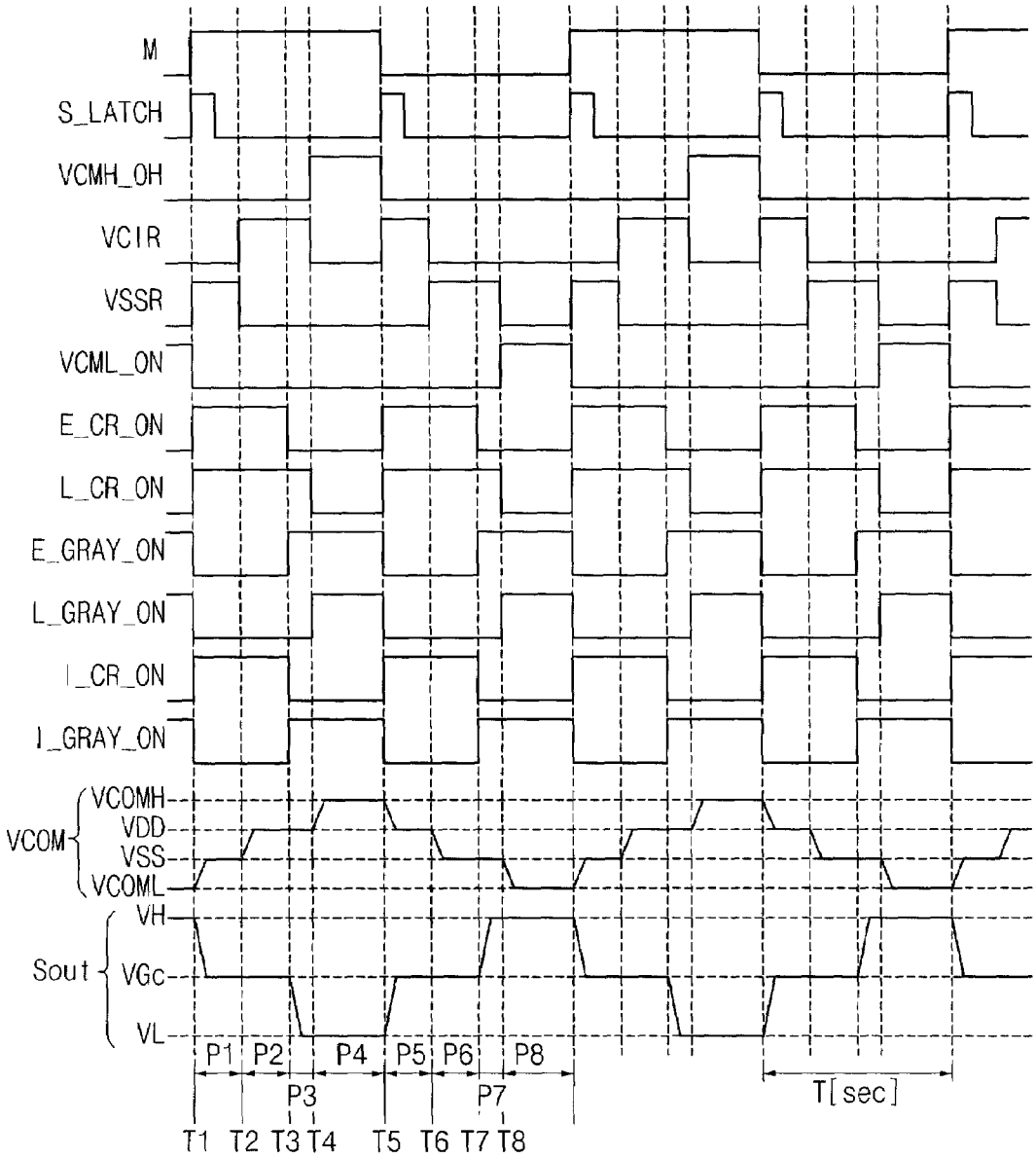
FIG. 9 is a timing diagram illustrating transitions of the output voltages of the source driving circuit of FIG. 5 and the common voltage driver circuit of FIG. 6.

FIG. 9 is a timing diagram illustrating transitions of the output voltages of the source driving circuit of FIG. 5 and the common voltage driver circuit of FIG. 6. FIG. 9 will be explained with reference to FIGS. 5 and 6. The worst case pattern is assumed in FIG. 9. The output signal of the common voltage driver circuit of FIG. 6 will be explained first, and the output signal of the source driving circuit of FIG. 5 will be explained later. In FIG. 9, the output signal of the panel type selector 531 is assumed to be logic "1". That is, the MSB of the display data Dm and the panel select signal NW_SEL are different from each other in FIG. 9.

Referring to FIG. 9, in the time period before time T1, with polarity control signal M at logic "0", the control signal VCML_ON is enabled (the switch 640 is closed), and control signals VCMH_ON, VCIR and VSSR are disabled. Accordingly, the common electrode VCOM is driven to VCOML by the second driver 620. In the time period before time T1, latch control signal S_LATCH is in the disabled state, control signals E_CR_ON and L_CR_ON are in the disabled state, and control signals E_GRAY_ON and L_GRAY_ON are in the enabled state. Accordingly, the first switching control signal I_CR_ON is in the disabled state to cause the switch 537 to be in the off state, and the second switching control signal I_GRAY_ON is in the enabled state to cause the switch to be in the on state. Therefore, the source output Sout is driven to VH, which is the highest grayscale reference voltage.

At time T1, the polarity signal M switches to logic "1" to invert the display data, the control signal VCML_ON is disabled to cause the switch 640 to be opened, and control signal VSSR is enabled to cause to the switch 655 to be closed, thereby connecting the VCOM node N to an intermediate voltage VSS (for example, ground). During the time period P1, VCOM is driven to VSS from VCOML.

While the exemplary embodiments of the present invention and their advantages have been described in detail, it should be understood that various changes, substitutions and alterations may be made herein without departing from the scope of the present invention. At time T1, control signals E_CR_ON aid L_CR_ON are enabled, and control signals E_GRAY_ON and L_GRAY_ON are disabled. Therefore, the first, output signal I_CR_ON is enabled to cause the switch 537 to be closed, and the second output signal I_GRAY_ON is disabled to cause the switch 539 to be opened, thereby connecting the output of the intermediate voltage generator 560 to the source output Sout. During time period P1, the source output Sout is driven to VGc from VH.

At time T2, the control signal VSSR is disabled to cause the switch 655 to be opened, the control signal VCIR is enabled to cause the switch 653 to be closed, thereby connecting the VCOM node N to the output of the third driver 651. Accordingly, during time period P2, VCOM is driven to VDD from AVSS by using the power supply VDD. During time period P2, the source output Sout is maintained at VGc, because the signals E_CR_ON, L_CR_ON, E_GRAY_ON, L_GRAY_ON, I_CR_ON and I_GRAY_ON are in the same state as during time period P1.

During time period P3, VCOM is maintained at VDD, the same state as time period P2. At time T3, the control signal E_CR_ON is disabled, and the first output signal I_CR_ON is disabled accordingly to cause the switch 537 to be opened, and the control signal E_GRAY_ON is disabled, and the second output signal I_GRAY_ON is disabled accordingly to cause the switch 539 to be closed, thereby connecting the output of the buffer 517 to the source output Sout. During time period P3, the source output Sout is driven to VL, the lowest grayscale reference voltage, from VGc. Accordingly, the source output Sout transits to the final level (VL) prior to VCOM.

At time T4, the control signal VCIR is disabled to cause the switch 653 to be opened, and the control signal VCMH_ON is enabled to cause switch 630 to be closed, and thereby connecting the output of the first driver 610 to the VCOM node N. During time interval P4, VCOM is driven to VCOMH from VDD by the first driver 610. During time period P4, the source output Sout is maintained at VL, the same state as during time period P3.

At time T5, the polarity control signal M switches to logic "0", the control signal VCMH_ON is disabled to cause the switch 630 to be opened, and the control signal VCIR is enabled to cause the switch 653 to be closed, thereby connecting the VCOM node N to the output of the third driver 651. During time period P5, VCOM is driven to VCOMH from VDD. At time T5, control signals E_CR_ON and R_CR_ON are enabled, and control signals E_GRAY_ON and I_GRAY_ON are disabled. Accordingly, the output signal I_GRAY_ON is disabled to cause the switch 539 to be opened, and the output signal I_CR_ON is enabled to cause the switch 537 to be closed, thereby connecting the output of the intermediate voltage generator 560 to the source output Sout. Accordingly, the source output Sout is driven to VL from VGc.

At time T6, the control signal VCIR is disabled to cause the switch 653 to be opened, and the control signal VSSR is enabled to cause the switch 655 to be closed, thereby connecting the VCOM node N to an intermediate voltage (VSS). During time period P6, VCOM is driven to VSS from VDD, and the source output Sout is maintained at VGc as in time period P5. During time period P7, VCOM is maintained at VSS as during time period P6.

At time T7, the control signal E_CR_ON is disabled, and the output signal I_CR_ON is disabled to cause the switch 537 to be opened. In addition, the control signal E_CR_ON is enabled, and the output signal I_GRAY_ON is enabled to cause the switch 539 to be closed, thereby connecting the output of the buffer 517 to the source output Sout. Therefore, during time period P7, the source output is driven to VH from VGc. During time period P7, the source output transits to a final level (VH) prior to VCOM.

At time T8, the control signal VSSR is disabled to cause the switch 655 to be opened, and the control signal VCML_ON is enabled to cause the switch 640 to be closed, thereby connecting the VCOM node N to the output of the second driver 620. Therefore, during time period P8, the VCOM is driven to VCOML from VSS, and the source output Sout is maintained at VH as in time period P7.

In FIG. 9, unlike in FIG. 8, the source output Sout transits to a final level (VL) prior to VCOM during time period P3, and the source output Sout transits to a final level (VH) prior to VCOM during time period P7.

In FIG. 9, the average load current consumption for VCOMH driven from AVDD is formulated by the following Equation 11.

$$I_{VCOMH}=(m(VCOMH-VDD)Ceq)/2T, \quad \text{[Equation 11]}$$

where m denotes a number of source channels, Ceq denotes an equivalent capacitance, and T denotes a toggling period of VCOM.

In addition, the average load current consumption for VCOML driven from VCL is formulated by the following Equation 12.

$$I_{VCOML}=-m*VCOML*Ceq/2T \quad \text{[Equation 12]}$$

Further, the average load current consumption for source driven from AVDD is formulated by the following Equation 13.

$$I_{SRC}=(m((VH-VL)/2-VCOML)Ceq)/2T \quad \text{[Equation 13]}$$

Further, the average load current consumption of source driver for VDD is formulated by the following Equation 14.

$$I_{VDD}=m*VCOML*Ceq/2T \quad \text{[Equation 14]}$$

In addition, the average load current consumption of VCOM driver for VDD is formulated by the following Equation 15.

$$I_{VDD}=m(VH-VL)/2*Ceq)/2T \quad \text{[Equation 15]}$$

When AVDD corresponds to an output voltage boosted by "a" from an external input power supply voltage, and VCL corresponds to an output voltage boosted by "−b" from the external input power supply voltage, the total average current consumption is formulated by the following Equation 16.

$$I_{TOT}=m(a(VCOMH-VDD+(1-b)VCOML+(VH-VL)/2)Ceq)/2T \quad \text{[Equation 16]}$$

When Equation 16 is subtracted from Equation 9, a difference of the current consumptions may be obtained as the following Equation 17.

$$m(a(VH-VL-VCOML)+(b-1)(VH-VL)/2)Ceq/2T \quad \text{[Equation 17]}$$

The current consumption is reduced by the amount of Equation 10 when the common voltage generator of FIG. 6 and the source driving circuit of FIG. 5 are employed, compared to when the sourcing driving circuit of FIG. 7 and the common voltage generator of FIG. 6 are employed, in addition, VCOML is a negative value, thus reduction of current consumption is relatively large.

Figure 10:
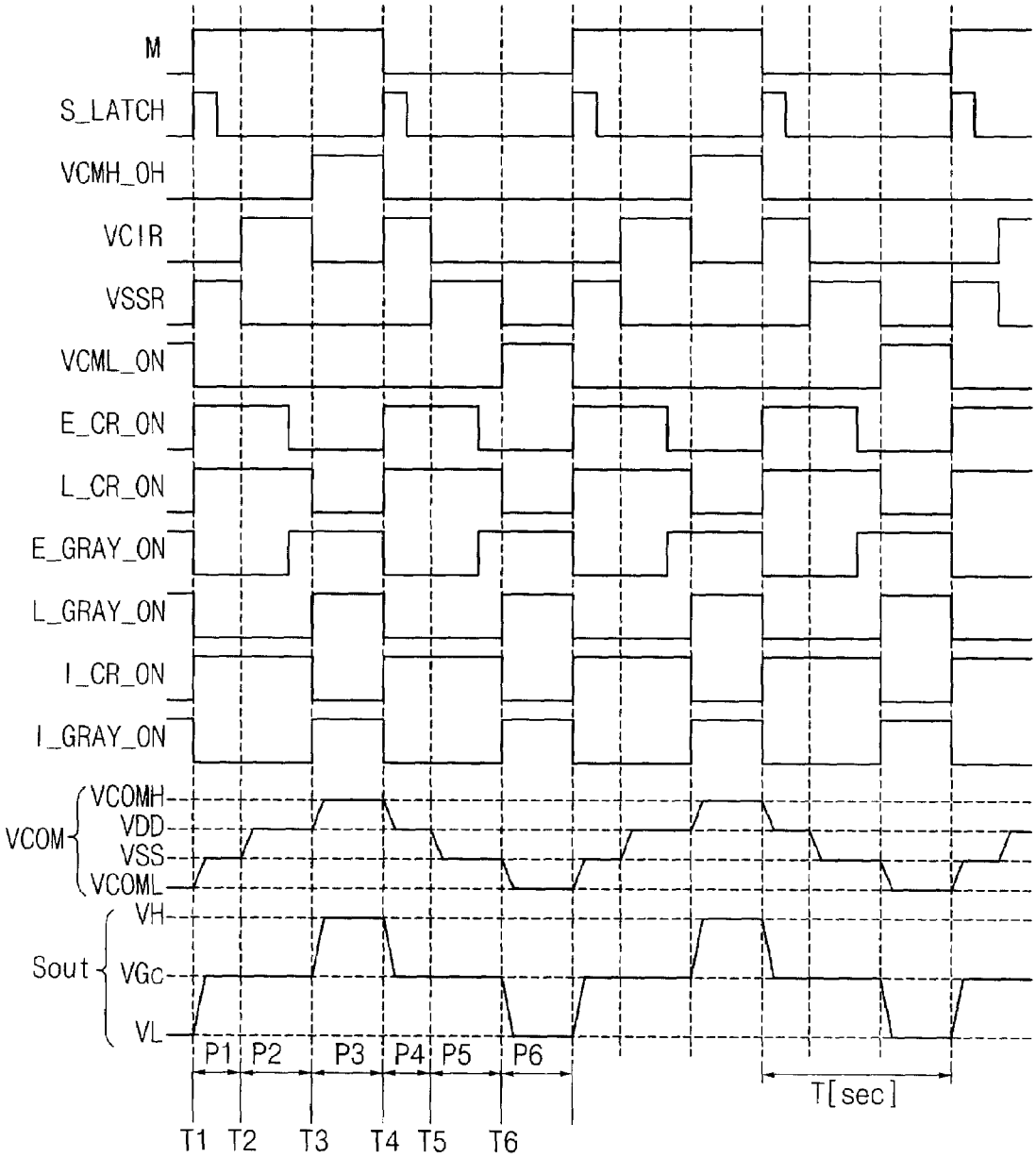
FIG. 10 is a timing diagram illustrating transitions of the output voltages of the source driving circuit of FIG. 5 and the common voltage driver circuit of FIG. 6 in case of the best case pattern.

FIG. 10 is a timing diagram illustrating transitions of the output voltages of the source driving circuit of FIG. 5 and the common voltage driver circuit of FIG. 6 in the case of the best case pattern. The best case pattern is assumed to be present and, thus, the output of the panel type selector 531 corresponds to logic "0".

In FIG. 10, timing diagrams are the same as in FIG. 9, except for the output signals I_CR_ON and I_GRAY_ON. Accordingly, time periods P3 and P4 will be explained.

At time T3, the output signal I_CR_ON is disabled, and the output signal I_GRAY_ON is enabled. The output signal I_CR_ON is identical to the control signal L_CR_ON, and the output signal I_GRAY_ON is identical to the control signal L_GRAY_ON. The control signal L_GRAY_ON corresponds to a switching control such that the source output Sout and VCOM may transit simultaneously to respective final levels. Therefore, VCOM and the source output Sout transit simultaneously to respective final levels (VCOMH and VH). At time T6, the output signal I_CR_ON is disabled, and the output signal I_GRAY_ON is enabled. Accordingly, VCOM and the source output Sout transit simultaneously to respective final levels (VCOML and VL) during time period P6. That is, reduction of current consumption is relatively large when VCOM and the source output Sout transit simultaneously to respective levels in the case of the best case pattern.

As described above, the source driving circuit, the method of driving the data line of the display, and the liquid crystal display apparatus including the same according to the exemplary embodiments of the present invention may significantly reduce current consumption by controlling timing of the transition to final levels of the source output and VCOM.

Having thus described exemplary embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A source driving circuit comprising:

a source driver circuit that receives display data and generates a source driving voltage corresponding to the received display data;

an intermediate voltage generator that generates an intermediate source driving voltage; and a switching control unit that receives a plurality of control signals for selectively applying the source driving voltage and the intermediate source driving voltage to data lines of a display as a driving voltage and controls an order of transition to final levels of a common electrode voltage and the driving voltage such that the driving voltage transits to the final level prior to the common electrode voltage when the driving voltage transits to a lowest grayscale reference voltage and the common electrode voltage transits to a high common voltage or when the driving voltage transits to a highest grayscale reference voltage and the common electrode voltage transits to a low common voltage, the common electrode voltage being applied to a common electrode of a liquid crystal capacitor coupled to the data line of the display, wherein the switching control unit comprises:

a panel type selector that outputs a panel select signal based on a data pattern bit of the display data and a panel type signal of the plurality of control signals;

a first switching signal controller that controls a timing for applying the intermediate source driving voltage to the data lines based on the panel select signal and first and second control signals of the plurality of control signals;

a second switching signal controller that controls a timing for applying the source driving voltage to the data lines based on the panel select signal and third and fourth control signals of the plurality of control signals;

a first switch that selectively connects the intermediate source driving voltage to the data lines in response to an output signal of the first switching signal controller; and a second switch that selectively connects the source driving voltage to the data lines in response to an output signal front the first switching signal controller.

2. The source driving circuit of claim 1, wherein the panel type selector comprises an exclusive-OR gate.

3. The source driving circuit of claim 1, wherein the first and second control signals control a transition timing of the intermediate source driving voltage to a final level.

4. The source driving circuit of claim 3, wherein the first switching signal controller comprises a 2-to-1 multiplexer.

5. The source driving circuit of claim 3, wherein the driving voltage transits to a final level prior to the final level of the common electrode voltage when the first switching signal controller selects the first control signal.

6. The source driving circuit of claim 3, wherein the driving voltage and the common electrode voltage transit simultaneously to respective final levels when the second switching signal controller selects the second control signal.

7. The source driving circuit of claim 1, wherein the third and fourth control signals control a transition timing of the source driving voltage to the final level.

8. The source driving circuit of claim 3, wherein the second switching signal controller comprises a 2-to-1 multiplexer.

9. The source driving circuit of claim 8, wherein the driving voltage transits to the final level prior to the common voltage when the second switching signal controller selects the third control signal.

10. The source driving circuit of claim 8, wherein the common electrode voltage and the driving voltage transit simultaneously to respective final levels when the second switching signal controller selects the fourth control signal.

11. The source driving circuit of claim 1, wherein the intermediate source driving voltage corresponds to a reference grayscale voltage.

12. The source driving circuit of claim 11, wherein the intermediate source driving voltage corresponds to a central reference grayscale voltage.

13. A liquid crystal display (LCD) apparatus including:

a liquid crystal display panel that includes a plurality of gate lines and a plurality of data lines; a gate driver that drives the plurality of gate lines; and a source driver that drives the plurality of data lines, the source driver comprising:

a source driver circuit that receives display data and generates a source driving voltage corresponding to the received display data; and a switching control unit that receives a plurality of control signals for selectively applying the source driving voltage and the intermediate source driving voltage to the plurality of data lines as a driving voltage and controls order of transition to final levels of a common electrode voltage and the driving voltage such that the driving voltage transits to the final level prior to the common electrode voltage when the driving voltage transits to a lowest grayscale reference voltage and the common electrode voltage transits to a high common voltage or when the driving voltage transits to a highest grayscale reference voltage and the common electrode voltage transits to a low common voltage, the common electrode voltage being applied to a common electrode terminal of a liquid crystal capacitor coupled to each of the plurality of data lines, wherein the switching control unit comprises:

a panel type selector that outputs a panel select signal based on a data pattern bit of the display data and a panel type signal of the plurality of control signals;

a first switching signal controller that controls a timing for applying the intermediate source driving voltage to the data lines based on the panel select signal and first and second control signals of the plurality of control signals;

a second switching signal controller that controls a timing for applying the source driving voltage to the data lines based on the panel select signal and third and fourth control signals of the plurality of control signals;

a first switch that selectively connects the intermediate source driving voltage to the data lines in response to an output signal of the first switching signal controller; and a second switch that selectively connects the source driving voltage to the data lines in response to an output signal of the first switching signal controller.

14. The LCD apparatus of claim 13, wherein the first and second control signals control a transition timing of the intermediate source driving voltage to a final level.

15. The LCD apparatus of claim 13, wherein the third and fourth control signals control a transition timing of the source driving voltage to a final level.

16. The LCD apparatus of claim 13, wherein the intermediate source driving voltage corresponds to a central reference grayscale voltage.

17. The LCD apparatus of claim 13, further comprising: a common voltage driver circuit that drives the common electrode voltage.

18. The LCD apparatus of claim 17, wherein the common voltage driver circuit comprises:

a first driver circuit that outputs a first common voltage;

a second driver circuit that outputs a second common voltage;

a first intermediate switch that selectively connects the first common voltage to a common electrode of the display panel in response to a first intermediate control signal;

a second intermediate switch that selectively connects the second common voltage to the common electrode in response to a second intermediate control signal; and an intermediate voltage output circuit that outputs one or more intermediate common voltages to the common electrode in response to one or more intermediate control signals.

19. The LCD apparatus of claim 18, wherein the first common voltage corresponds to a high common voltage and the second common voltage corresponds to a low common voltage.

20. The LCD apparatus of claim 19, wherein the common voltage driver circuit drives the common electrode from the low common voltage to the high common voltage by driving the common electrode with the one or more intermediate common voltages before outputting the high common voltage.

21. The LCD apparatus of claim 19, wherein the common voltage driver circuit drives the common electrode from the high common voltage to the low common voltage by driving the common electrode with the one or more intermediate common voltages before outputting the low common voltage.

22. A method of driving data lines of a display, comprising:

generating a source driving voltage corresponding to received display data;

generating an intermediate source driving voltage;

receiving a plurality of control signals for selectively applying the source driving voltage and the intermediate source driving as a driving voltage to a data line of the display; and controlling an order of a transition to final levels of a common electrode voltage, the source driving voltage and the intermediate source driving voltage such that the driving voltage transits to the final level prior to the common electrode voltage when the driving voltage transits to a lowest grayscale reference voltage and the common electrode voltage transits to a high common voltage or when the driving voltage transits to a highest grayscale reference voltage and the common electrode voltage transits to a low common voltage, the common electrode voltage being applied to a common electrode terminal of a liquid crystal capacitor coupled to the data line of the display, wherein the step of controlling an order of the transition comprises, outputting a panel select signal based on a data pattern bit of the display data and a panel type signal of the plurality of control signals;

applying the intermediate source driving voltage to the data lines by a first switching based on the panel select signal and first and second control signals of the plurality of control signals; and applying the source driving voltage to the data lines by a second switching based on the panel select signal and third and fourth control signals of the plurality of control signals.

23. The method of claim 22, wherein the panel select signal is inactivated when the data pattern bit and the panel type signal are inactivated exclusively.

24. The method of claim 22, wherein one of the first and second control signals is selected in the first switching.

25. The method of claim 24, wherein the driving voltage transits to a final level prior to the common electrode voltage when the first control signal is selected in the first switching.

26. The method of claim 24, wherein the driving voltage and the common electrode voltage transit simultaneously to respective final levels when the second control signal is selected in the first switching.

27. The method of claim 22, wherein one of the third and fourth control signals is selected in the second switching.

28. The method of claim 27, wherein the driving voltage transits to a final level prior to the common electrode voltage when the third control signal is selected in the second switching.

29. The method of claim 27, wherein the source driving voltage and the common electrode voltage transit simultaneously to respective final levels when the fourth control signal is selected in the second switching.

* * * * *